US005908505A

United States Patent [19]

Bargenquest et al.

[11] Patent Number: 5,908,505

[45] Date of Patent: Jun. 1, 1999

[54] HIGH VOLUME, TEXTURED LIQUID TRANSFER SURFACE

[75] Inventors: Brian M. Bargenquest, Carrollton; James E. Taylor, Dallas, both of Tex.

[73] Assignee: Questech, Inc., Carrollton, Tex.

[21] Appl. No.: 08/711,600

[22] Filed: Sep. 10, 1996

[51] Int. Cl.[6] ..... B05C 1/00

[52] U.S. Cl. ..... 118/211; 118/46; 118/212; 118/249; 118/262; 101/415.1

[58] Field of Search ..... 118/46, 211, 212, 118/249, 262; 101/415.1; 427/428

[56] References Cited

U.S. PATENT DOCUMENTS

| | | | |
|---|---|---|---|
| 3,166,012 | 1/1965 | Hantscho | 101/415.1 |
| 3,268,982 | 8/1966 | Schutze . | |
| 3,391,673 | 7/1968 | Knapp et al. . | |
| 3,513,772 | 5/1970 | Brasty | 101/415.1 |
| 4,685,414 | 8/1987 | DiRico | 118/46 |
| 4,779,557 | 10/1988 | Frazzitta . | |
| 4,796,556 | 1/1989 | Bird | 118/46 |
| 4,841,903 | 6/1989 | Bird | 118/46 |
| 5,178,678 | 1/1993 | Koehler et al. | 118/211 |
| 5,330,799 | 7/1994 | Sandor et al. | 118/212 |
| 5,476,043 | 12/1995 | Okuda et al. | 118/46 |
| 5,714,197 | 2/1998 | Suzuki et al. | 427/162 |

*Primary Examiner*—Peter Chin
*Assistant Examiner*—Michael P. Colaianni
*Attorney, Agent, or Firm*—Fish & Richardson P.C.

[57] ABSTRACT

In-line printing and coating method achieves high coat weights (e.g, over 0.7 lb./1,000 sq.ft.) characteristic of blister seal operations and/or high gloss and high scuff resistance requirements, substantially without deleterious slinging. A high volume of coating is applied to a substrate by a coating cylinder supporting a resilient coating transfer surface consisting of an array of laser engraved coating-carrying indentations having substantially equal volumes that are uniformly distributed. An impression surface is positioned adjacent to the coating cylinder, positioned to impress a substrate between the coating transfer surface and the impression surface. A supply roll has a surface for applying liquid coating to the resilient transfer surface. The supply roll surface and the resilient transfer surface are in pressure contact, and adjacent surfaces of the supply roll and the coating cylinder rotate in the same direction. A metering member contacts the supply roll, so the load on the supply roll is metered before it is imparted to the resilient transfer surface. Resilient polymer and rubber surfaces carrying high volumes of coating are also disclosed. The cylinder supporting the resilient transfer surface can be advantageously used in other applications, for instance a roll of a keyless inker of an offset printing unit in a printing press.

27 Claims, 4 Drawing Sheets

HIGH VOLUME, TEXTURED LIQUID TRANSFER SURFACE

BACKGROUND OF THE INVENTION

This invention relates to coating transfer surfaces on an apparatus which transfers metered amounts of liquid to a substrate, for example to coat or print a workpiece.

Liquid coatings are applied to printed sheets (or webs) for many reasons including: surface protection, scuff resistance, gloss, and faster drying to prevent ink offsetting and smudging. Faster drying is particularly important to improving productivity while printing and coating in-line. Coatings also reduce use of spray powders, which may improve handling of slower drying workpieces, but can be detrimental to the cosmetic appearance, look, and feel of the printed/coated product.

Matte, semi-gloss, medium and high gloss (water base) coatings and the increasingly popular UV (ultra violet) and EB (electron beam) coatings with high-gloss capabilities are commonly used today. Many variables affect gloss, including the coating's thickness, smoothness (lay when drying is initiated), physical properties, and application techniques, as well as the surface upon which coating is applied. All other things being equal, thicker coatings generally provide higher gloss, improved scuff resistance or increased barrier properties.

Another applications for coating printed workpieces involve retail packages known as blister pacs, in which the product is encased in a clear plastic bubble that is adhered to a printed paperboard. Water based adhesive is applied to the paperboard "off-line", in an operation that is performed after, and separate from, printing. A bond or seal is established between the plastic bubble perimeter and a corresponding coated margin on the paperboard by applying pressure and heat to borders of the plastic and to the paperboard. One hundred percent "fiber-tare" (seal) is generally desirable and often times a requirement. A fiber-tare value can be determined in a destructive test, by separating the plastic bubble from the coated board. One hundred percent fiber-tare (a complete seal at the plastic/board interface) is said to be achieved when dried blister coating, ink, and paper coating, if any, are attached to the plastic, leaving only board fibers on the surface of the board in a continuous line extending completely around the periphery of the bubble. It is generally accepted that 100% fiber-tare requires dry coat weights of at least 0.76 to 0.8 lb/1,000 sq.ft., the latter dry coat weight being the equivalent of a wet coat weight of 2¼ lb./1,000 sq.ft., when solids are 35%. In order to apply 2¼ lb./1,000 sq.ft. of wet coating to the blanket, the coating surface and adjacent coater roll(s) often must carry a coat weight in excess of the weight-to-surface area ratio of the workpiece being coated. This relatively heavy layer of wet liquid coating presents certain operational problems (particularly for in-line or other high-speed operations), including drying and slinging (described below).

One effort to apply the blister coating in-line with a printing process involves extending the delivery of the sheet-fed press to provide more drying time. Extending the press delivery does not ameliorate slinging, however, which can occur when a heavy blister coating is transferred to a conventional smooth offset blanket on the blanket cylinder of a sheet-fed press and from there to the board substrate. The smooth blanket is capable of carrying only so much liquid before coating accumulates at the "in" running nip between the coater applicator roll and the blanket and/or at the interface of the surface of the blanket and the sheet. Excess coating then rolls back to, and into, the blanket cylinder gap, where it accumulates and then slings off the blanket cylinder or sheet. Slinging, of course, is a serious problem, and, to avoid slinging, the coat weight applied in-line must be reduced to a level below that which is required to effect complete blister sealing.

U.S. Pat. No. 4,685,414 issued to Mark DiRico entitled "Coating Printed Sheets" discloses metering coating to a blanket by using a textured roll, for example, an engraved anilox roll, with a hard rigid surface of microscopic, uniform, coating-carrying cells.

U.S. Pat. No. 4,779,557 ("Frazzitta") discloses a three-roll coater for coating the blanket of a blanket cylinder on the last unit in an offset sheet-fed printing press. The applicator roller surface and blanket surface of blanket cylinder move in opposite directions and are set in light ("kiss") contact or with a small gap. Frazzitta discloses a "possible elastomeric blanket" having a "pattern of surface depressions" for receiving liquid coating for transfer to individual fed sheets at the nip.

For applications in which adjacent surfaces move in the same direction, heavy coatings are often applied off-line, where the heavy coat weights can be applied and dried at relatively low production speeds through long tunnel dryers. Typically, the equipment required is very expensive and off-line operations are time consuming, so total production cost is increased.

SUMMARY OF THE INVENTION

We have discovered an in-line printing and coating method which achieves high dry coat weights (e.g, over 0.7 and usually over 0.8 lb./1,000 sq.ft.) characteristic of blister seal operations and/or high gloss, high scuff resistance and barrier requirements, substantially without deleterious slinging. This increased loading is achieved at production speed and with only minor (if any) modifications to the press set-up and coater. Our discovery provides the following features and advantages: 1) the coater roll has the ability to apply the required coat weight; and 2) the press has the ability to receive, carry and apply the coating without roll-back and slinging. We specifically avoid slinging from the blanket cylinder and sheet as coating is being applied to the blanket and from the blanket to the just printed sheet.

One aspect of the invention generally features an apparatus comprising a liquid coater for applying a high volume of coating to a substrate. The coater includes a coating cylinder supporting a resilient coating transfer surface made up of an array of small coating-carrying indentations (e.g., the cells or reliefs described below). Distribution and size of the indentations over the blanket surface is sufficiently uniform to provide the high volume of coating to the coated workpiece surfaces without unacceptable variations in the coating. The apparatus also includes an impression surface adjacent to the coating cylinder, positioned to impress a printed substrate between the coating transfer surface and the impression surface. A coating supply roll has a surface for applying an above-normal volume of liquid coating to the resilient coating transfer surface on the coating cylinder. The coating supply roll surface and the coating transfer surface are in positive pressure contact, so that continuous surface contact is made both circumferentially around and along the length of the two surfaces as both surfaces rotate. For example, adequate contact pressure is achieved when a minimum contact stripe width of approximately 2.5 mm is observed between the two static surfaces placed together "on impression". The resilient coating transfer surface is indented and hydrodynamically separated from the coating supply roll surface by liquid therebetween. Adjacent surfaces must therefore rotate in the same direction and (usually) at or very near the same speed. Finally, the apparatus includes a metering member (blade or roll) contacting the coating supply roll, so the load of coating on the supply roll is metered before it is imparted to the resilient coating transfer surface. As a result, the resilient transfer surface carries a continuous, uniform and heavy liquid layer of coating.

Preferred embodiments of this aspect of the invention feature the above described liquid coater positioned in-line with a sheet fed printing press, for example, an offset lithographic press unit. The liquid coater may be achieved by adding to a press unit the coating supply roll and the metering member. In that case, the impression surface, the blanket cylinder (which will have a gap if it is a sheet-fed press), or both, may be cylinders of the retrofitted press unit.

The coating carrying indentations of the resilient transfer surface may be configured and designed to accommodate a high volume of any of a variety of coatings, including water base coatings, ultra-violet coatings and the like, or to accommodate a blister-seal adhesive coating. While the coating load on the supply roll surface is sufficient to supply the high volume of coating to the resilient transfer surface, the volume released is not so high as to exceed the carrying capacity of the resilient transfer surface. For example, the load carried on these roll surfaces is designed to apply a coating which, when dried, is at least 0.7 lb./1,000 sq.ft., more preferably at least 0.75 lb/1,000 sq.ft., and most preferably at least 0.8 lb/1,000 sq.ft.

As noted, the indentations can be cells defined by walls which separate coating-carrying indentations. Preferably, such cells are formed on the smooth resilient printing blanket surface, e.g., by a laser beam. More specifically, the cells can be cavities (reliefs), e.g., in a honeycombed pattern in which the cells form a pattern of rows which are oriented at an angle of about 30° to the axis of the coating cylinder.

Alternatively, the indentations can be interconnecting reliefs around dots, formed in a pattern by a photo-developing process. For example such a pattern can be a line pattern that is formed in a photopolymer plate. Alternatively, such patterns may be formed on a rubber plate having surface indentations molded onto it. More specifically, the reliefs or voids around the dots are produced by developing or molding a screen, e.g., a 2%, 4%, or 10% screen, capable of providing the high coating load to the substrate.

As noted, the coating supply roll may be selected to carry a high volume of coating and to apply that high volume of coating to the resilient transfer surface, sufficient to fill the cells therein, without slinging of coating from the resilient transfer surface or from the coating cylinder or sheet substrate.

The apparatus described above can be used in a method of applying a high volume of coating or most liquids to a substrate. The apparatus applies liquids carried by the cells or reliefs on the specific resilient indented surface, by presenting the substrate between the resilient surface and the impression surface.

This aspect of the invention also features a resilient coating carrier produced by: a) treating a surface of a resilient printing blanket with a laser to form coating carrying cells on the surface; b) photoprocessing a surface of a resilient polymer sheet to form an array of dots surrounded by the relieved coating-carrying areas on the surface; or c) molding a resilient rubber sheet and forming on the sheet a surface having an array of indentations or dots surrounded by the coating-carrying relieved areas.

A second aspect of the invention features apparatus having a resilient liquid carrying surface for applying a specific volume of liquid to a substrate. The surface has indentations to receive, carry and apply liquid, and the liquid carrying capacity of the surface is substantially uniform over the entire liquid carrying surface. The surface can be used on a cylinder or roll in a keyless inker, for instance, for supplying ink to sheets or to a continuous web substrate. This apparatus permits controlled delivery of specific volumes of inks, particularly viscous inks which can be accommodated as described above for coatings or in longitudinal spiralling cells running axially along the length of the ink-transfer surface.

Either aspect of the invention can be used to deliver liquids and coatings; or ink to a sheet or a continuous web in a keyless inking system.

DESCRIPTION OF THE PREFERRED EMBODIMENTS

Figure 1:
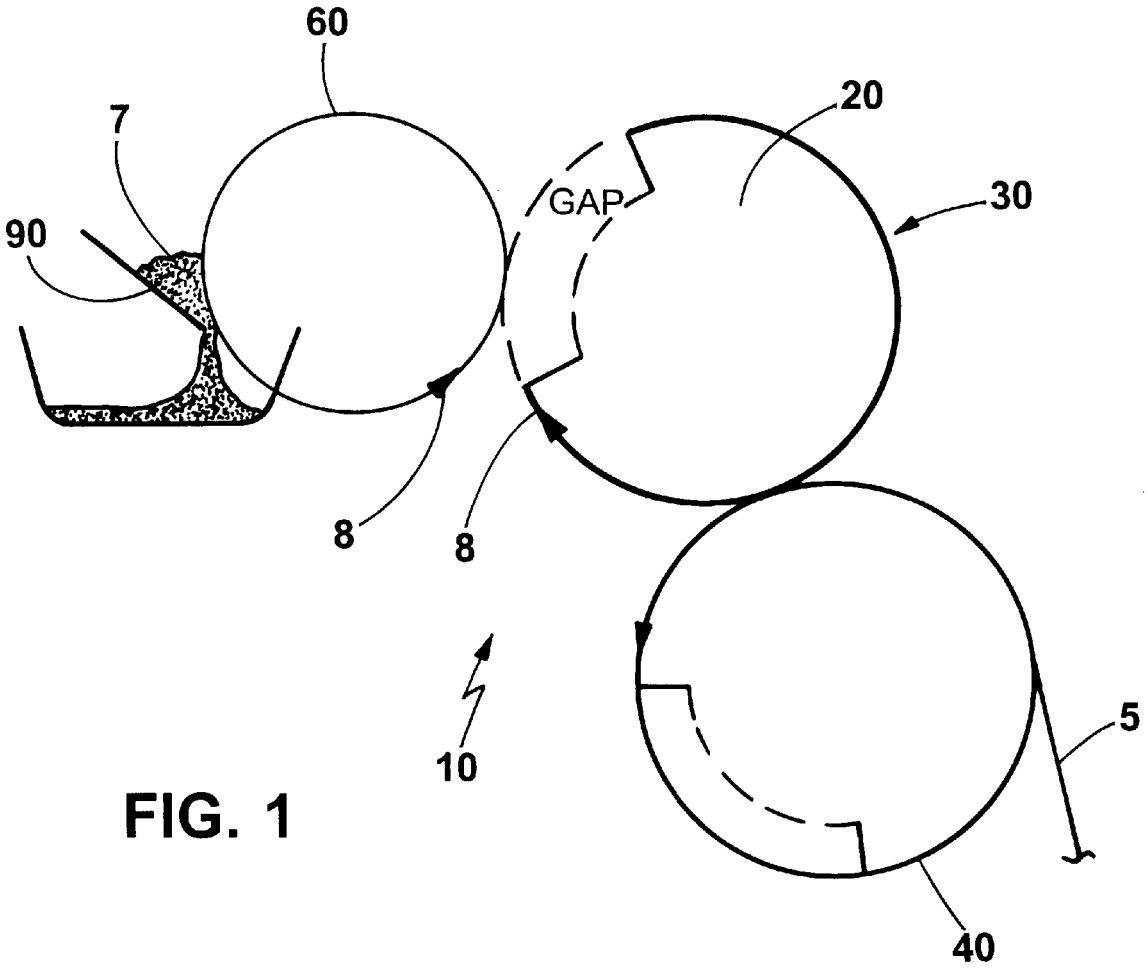
FIG. 1 is a diagrammatic side view of a coater.

In FIG. 1, coater 10 operates in line with a printing press, receiving a printed sheet 5 from an upstream press unit and delivering the coated sheet to the press delivery. Typically, coater 10 is a standard lithographic press unit that has been converted or retrofitted to be a coater. See DiRico U.S. Pat. No. 4,685,414.

Specifically, coater 10 includes a reservoir of water based coating and a pump where conduits (not shown) transfer the coating from the reservoir to a coating supply and metering system which applies it to the surface of a resilient blanket or plate 30 on the blanket cylinder 20 of the press unit. The printed sheet 5 is transferred to the nip between the blanket cylinder and an impression cylinder 40, where the sheet receives coating from the blanket or plate and is then moved on to the delivery station. Coating is supplied to blanket or plate surface 30 by a coating supply roll 60, which in turn receives coating from a supply 7. A metering member such as a doctor blade 90 (or a metering roll) controls the amount of coating transferred by supply roll 60.

Blanket or plate surface 30 has a resilient coating transfer surface, with an array of coating carrying indentations, cells or reliefs distributed uniformly over that surface. We have found three suitable methods of producing the desired surface on, or in, the coating applying surface 30.

I. Laser-engraving a standard blanket

Figure 2A:
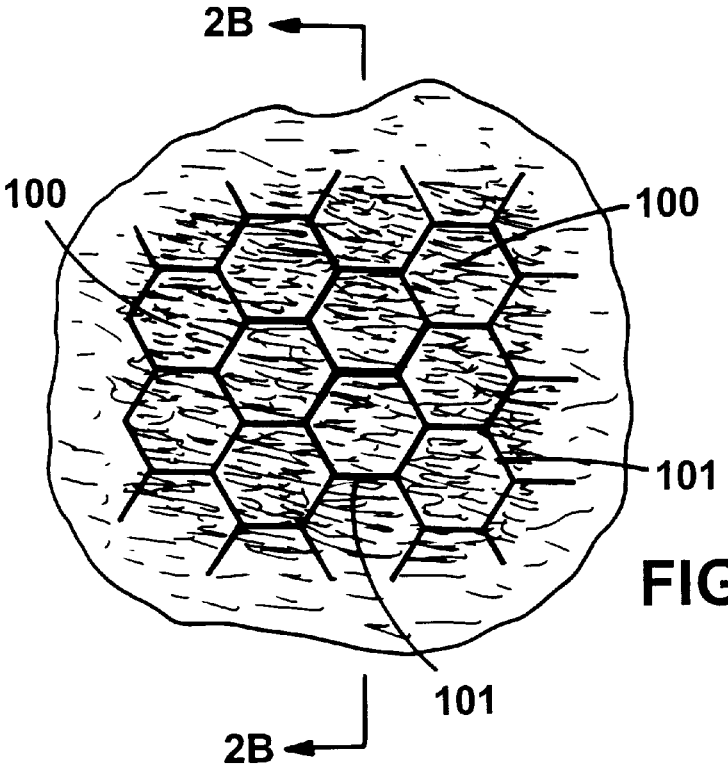
FIG. 2A is an enlarged view of a laser-treated blanket surface.
Figure 2B:
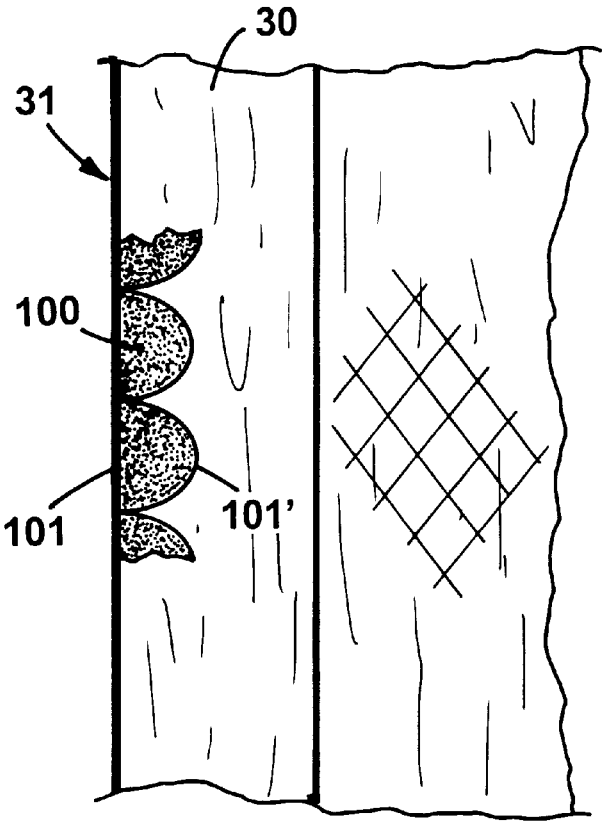
FIG. 2B is a section of the enlarged surface shown in FIG. 2A.

A laser beam can be used to engrave the surface 31 of a standard, smooth offset blanket 30 wrapped around a cylindrical mandrel, forming an excellent cell structure for producing a coating carrying and applying surface. One such structure looks much like a honeycomb with individual hexagonal shaped cells 100 (FIGS. 2A and 2B). The coating volume carried by the blanket surface is controlled by selecting the number of cells per sq.in. [or (lines/in.)$^2$] and by selecting the cell depth and shape. Cell lands 101 with bottoms 101' are rounded generally in a shape similar to that in a laboratory test tube as shown in FIG. 2B.

In one example, standard offset blankets were laser engraved to the specification provided by Pamarco, Inc. of Providence, N.J., whose midwest division is located in Batavia, Ill. According to that specification, the cell-to-cell alignment is set at a 30 deg. angle to the roll axis. There are $140^2$ cells/square inch. ("140 Quad."), and the cell volume is 19.8 BCM (billion cubic microns) per square inch. An alternative Pamarco specification provides $110^2$/ cells/ square inch, and a volume of 25.5 BCM/$in^2$. Coat weights applied were well above the 0.7 to 0.8 lb./1,000 sq.ft. requirement for 100% fiber-tare. The resulting seal was judged to be good to excellent. There was no evidence of slinging from the blanket cylinder or the sheet. The coating supply roll selected to apply the required, above normal, volume of coating to the blanket was made to Pamarco's specification for a mechanically engraved roll: 120 Quad Roto-Flo™, tool 146, vol. 27.2 BCM/$in^2$. This specification contrasts with the 140 Q Roto-Flo™, tool 138, vol. 15.0 BCM/sq.in. engraving that is normally used for standard water-base coating applications producing approximately 0.6 lbs/1,000 $Ft^2$ and without slinging.

II. Developing a Photopolymer plate

Alternatively, the desired liquid carrying surface can be produced from a photopolymer plate rather than a standard blanket. It is desirable to produce the same or similar liquid carrying cell volume as that which was produced by laser engraving of the blanket.

Figure 3A:
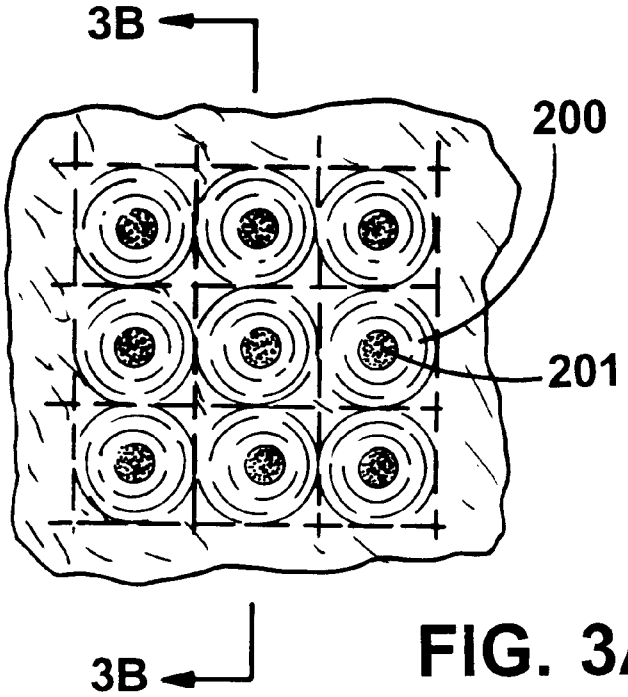
FIG. 3A is an enlarged view of a photopolymer plate.
Figure 3B:
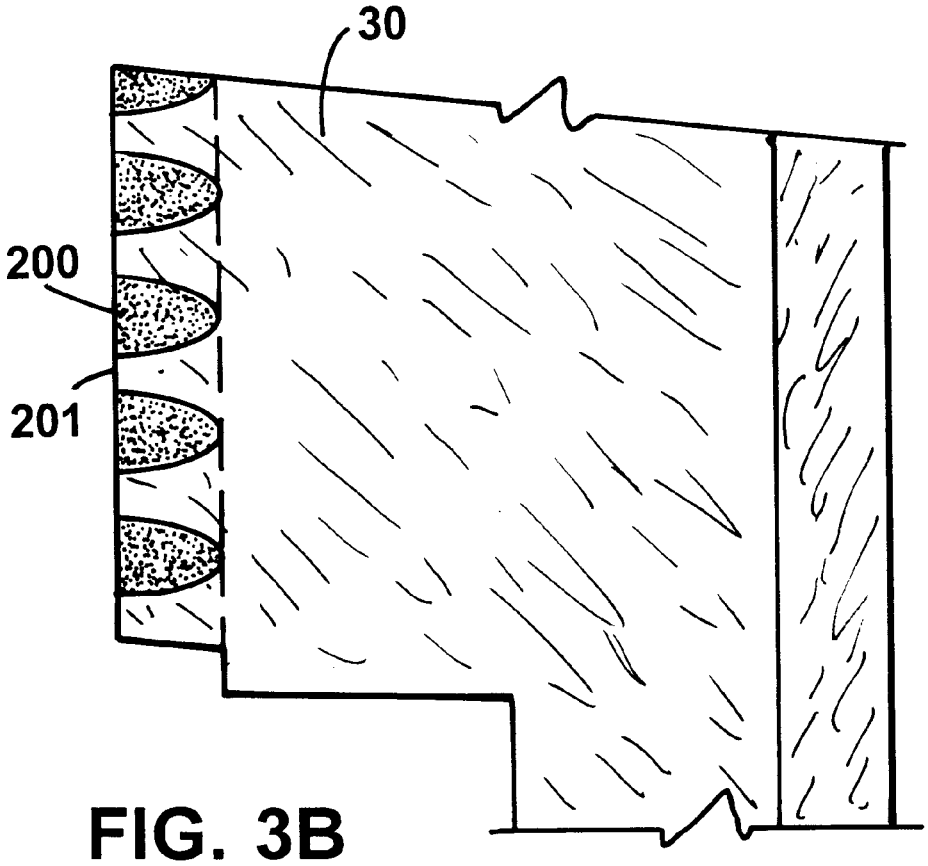
FIG. 3B is a section of the photopolymer plate of FIG. 3A.

Plates developed for flexographic printing have a resilient photopolymer surface but can be accurately developed to form voids with volumes close to those being produced on a blanket by a laser. A dot pattern developed on a photopolymer plate using a 120 line 2, 4 or 10% screen (percent number is the percent of ink coverage/sq. in, printed) provided non-image (relief) areas having equivalent volumes as those engraved areas seen in the above-described laser engraved blanket. A 30 power glass can be used to view this pattern (FIGS. 3A and 3B). In flexography, the top surface of the plate accepts a thin flexo ink and forms individual dots of varying diameters on the printed sheet, the void areas (relieved areas) between the dots do not print. Unlike flexographic printing, the invention uses the void areas 200 between the dots 201 to carry liquid that is transferred to the workpiece. The dots and void areas are all uniform in diameter and depth. In order to carry a uniform but maximum amount of coating in these voids, while at the same time minimizing the depth of the coating carrying regions, the dots necessarily are quite small to leave more area for the indented coating-carrying area. Hence, a 2, 4 or 10% screen is preferably used particularly to satisfy blister seal requirements. For spot coating only certain blanket or plate areas, the surface area that is not to receive coating is cut much deeper than in the areas where coating is to be received. In addition, when spot coating, it is necessary not only to rotate the two adjacent surfaces—i.e. the surfaces of the coating supply roll and the resilient coating conveying surface supported by the coating cylinder—in the same direction, but also to rotate the supply roll surface at substantially the same surface speed as that of the coating carrying surface. Otherwise, coating may build up along horizontal outlines of the deeper areas.

A photopolymer plate with the specified lines/in., screen pattern and controlled depth of relief given above, provides a volume sufficient for blister sealing. Channels provide flow between the dots, for good release and coating continuity as well as uniformity and smoothness. Still another advantage is that the cost of a photopolymer plate is significantly less than a laser engraved surface on an offset blanket.

III. Molded rubber plate

Still another method of producing the desired surface is to produce a molded rubber plate. The plate is duplicated from a mold or matrix that was in turn produced from an original photo-engraved metal pattern. A dot structure and relief can be produced similar to that discussed for the photopolymer plate (FIGS. 3A and 3B). A large number of printing plates may be made from the same mold.

Other Embodiments

While the above description concerns the application of coating, this technology can also be used for printing. The resilient liquid carrying surface disclosed can also be on that of a rotating roll or cylinder, either continuous, like that of an inking roll, or discontinuous, like a replaceable blanket on a cylinder having a gap along the length thereof. It is therefore anticipated that such a liquid carrying surface can especially be used on a single form roll "keyless" inker to great advantage.

Figure 4:
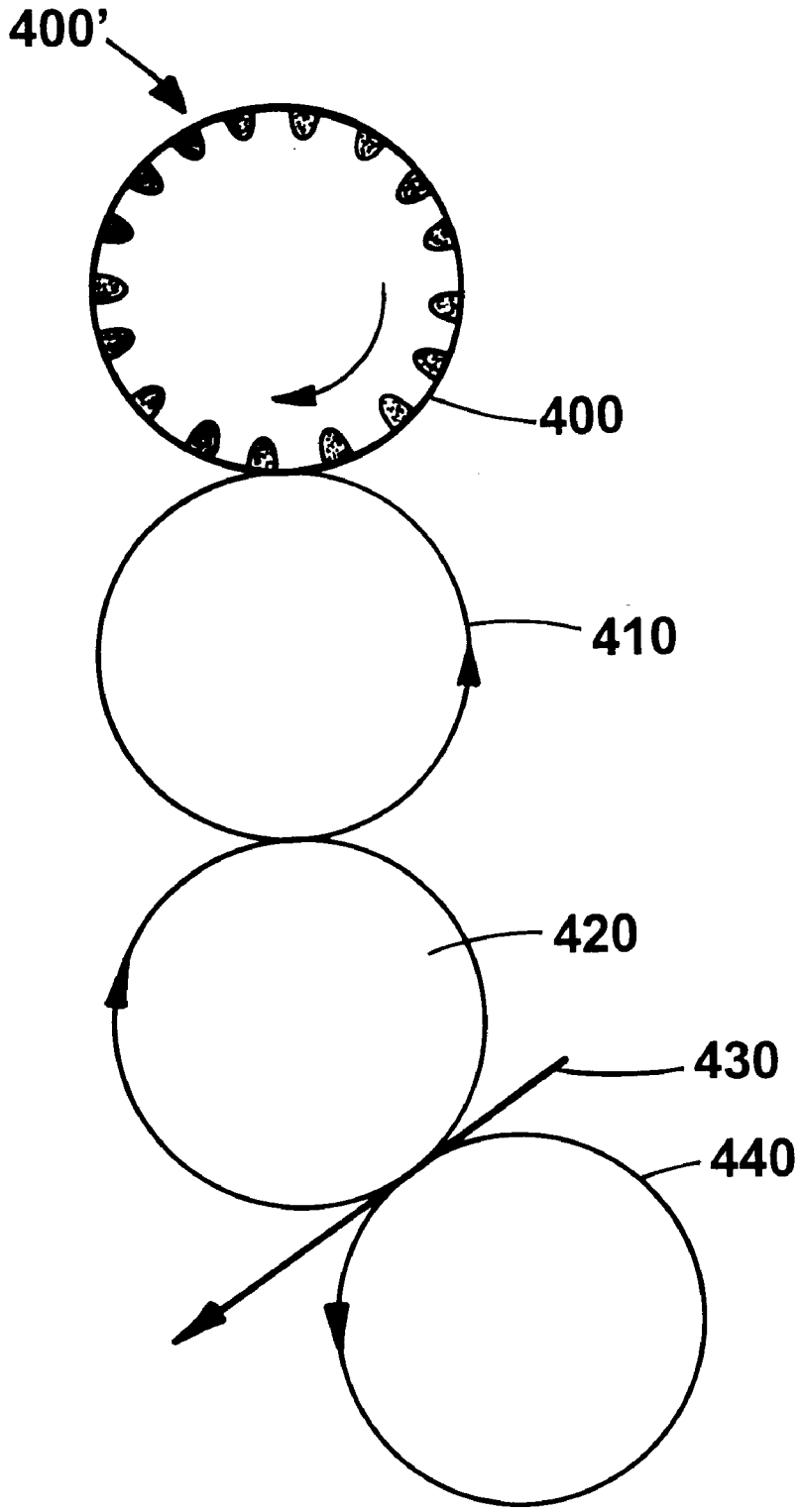
FIG. 4 is a diagrammatic view of an inking system.

Such a keyless inker is shown in FIG. 4. The resilient surface 400 receives, carries and applies the ink directly to image areas on the hard surface of a lithographic printing plate or a waterless plate mounted on cylinder 410 in an offset printing press. The plate applies the inked image to a blanket on cylinder 420 which prints to the workpiece 430. Pressure is applied by an impression cylinder 440 in the standard way. Ink is applied and metered to the resilient surface 400 via application of a doctor blade or roll 400' where empty cells (those depleted by the image on the plate) are replenished. Any surface ink remaining and ink replenished in the cells or voids serves as a lubricant to the blade and roll. Hence, component life is significantly increased. For viscous liquids like offset inks, the cell may take the form of continuous channels (grooves), running the full length of the roll or cylinder surface and spiraling about the length of the roll or cylinder. These spirals are similar to the rifling in a gun barrel, except that the spirals are on the outside diameter instead of inside, and, of course, the spirals are much closer together than rifle grooves. Pamarco's Tri-Helical specification shows a 200 line 12.0 BCM/$in^2$ volume which should be sufficient to apply a normal 12 micron ink film to a sheet substrate. The trihelical pattern of this product is much like what is described above. However, when engravings listed herein were engraved on or in hard surfaces which did not conform to adjacent hard surfaces like board, paper or metallic printing plates, it was necessary for a resilient surface to carry heavier and/or viscous as well as non-viscous water-like volumes of liquids, coatings and inks and without roll back and slinging.

Other embodiments, configurations and/or adaptations are considered to be within the following claims; for example, indentations (voids) in the liquid receiving, carrying and applying surface may be formed by sanding, grinding and/or sand blasting (or the like), as long as corresponding surface areas over the blanket, plate or roller covering applying surface have substantially equal volume carrying capacities sufficient to produce a substantially smooth, continuous, unbroken and uniform liquid layer or film of more than normal thickness over the substrate which was impressed against the liquid applying surface by an impression surface.

Still another method of forming said cavities (or voids) is to use a hardtool (wheel, roll, or die, etc.) to impress the resilient liquid applying surface to permanently set or emboss (smash) the surface such that substantially uniform indentations are formed in and over the liquid applying surface.

What is claimed is:

1. Apparatus for applying a high volume of liquid to a substrate, comprising:

a) a liquid-carrying cylinder or roll supporting a resilient liquid transfer surface, the liquid transfer surface having an array of small liquid-carrying surface indentations that are substantially uniformly sized and distributed over the surface;

b) a liquid supply roll having a surface for applying liquid to the resilient liquid transfer surface on the liquid-carrying cylinder; the liquid being carried by the small liquid-carrying surface indentations in the resilient liquid transfer surface of the liquid carrying cylinder; the liquid supply roll surface and the liquid transfer surface supported on the liquid-carrying cylinder being in positive pressure contact, said positive pressure contact ensuring that the liquid supply roll surface and the liquid transfer surface move together in the same direction;

c) a metering member contacting the liquid supply roll surface, wherein liquid load on the supply roll is metered before it is imparted to the resilient liquid transfer surface supported on the liquid-carrying cylinder; and d) an impression surface positioned to apply pressure to the substrate so as to cause the substrate to receive the liquid transferred by the resilient liquid transfer surface.

2. The apparatus of claim 1 wherein the apparatus for applying the high volume of liquid to the substrate is in-line with at least one printing unit of a printing press, and the liquid-carrying cylinder comprises a gap formed in the surface therein.

3. The apparatus of claim 2 wherein the resilient liquid transfer surface supported on the liquid-carrying cylinder is a surface of a resilient offset blanket which comprises the surface indentations formed therein.

4. The apparatus of claim 1 wherein the resilient liquid transfer surface supported on the liquid-carrying cylinder is a surface of a polymer or a rubber plate onto which the liquid-carrying indentations have been formed by photoprocessing or by molding.

5. The apparatus of any of claims 1, 2, 3, or 4 wherein the liquid-carrying indentations of the resilient transfer surface are configured and designed to accommodate a high volume of a water base coating, ultra-violet coating, electron-beam coating, blister-seal adhesive, or barrier coating.

6. The apparatus of claim 5 wherein the indentations on the resilient liquid transfer surface are cells formed by a laser beam.

7. The apparatus of claim 5 wherein the resilient liquid transfer surface comprises dots with relief areas around the dots, the reliefs and dots being formed by a photo-developing or molding process.

8. The apparatus of claim 5 wherein the supply roll and the liquid-carrying cylinder or roll are configured so as to allow the surface of the supply roll and the resilient liquid transfer surface supported on the liquid-carrying cylinder to have substantially the same surface speed.

9. The apparatus of claim 5 wherein liquid supply roll surface and said metering member are designed and configured to establish a liquid load on the supply roll surface sufficient to supply a high volume of liquid to the resilient liquid transfer surface but not so high as to exceed the carrying capacity of the resilient liquid transfer surface and thereby cause slinging.

10. The apparatus of any claim of claims 1, 2, 3, or 4 wherein the liquid supply roll and resilient liquid transfer surface are configured to carry a liquid load sufficient to apply to the substrate a liquid which, when dried, is at least 0.7 lb./1,000 sq.ft.

11. The apparatus of claim 10 wherein the indentions are capable of carrying sufficient liquid to deliver not less than approximately 0.8 lb. dry weight per 1,000 sq.ft. to the substrate.

12. The apparatus of claim 7 wherein the reliefs or the dots are produced by developing or molding a screen.

13. The apparatus of claim 12 wherein the screen is a 2%, 4%, or 10% screen.

14. The apparatus of claim 13 in which the resilient surface produced with said screen is capable of providing to the substrate approximately 0.8 lb. dry weight/1,000 sq.ft.

15. The apparatus of claim 1 in which the impression surface, the liquid-carrying cylinder, or both, are cylinders of an offset press unit, fitted with the liquid supply roll and the metering member, and wherein the liquid supply roll surface and the resilient liquid transfer surface supported by the liquid-carrying cylinder define therebetween a contact stripe width, as the surfaces rotate, of at least 2.5 mm.

16. The apparatus of claim 1 wherein the liquid-carrying cylinder or roll, the liquid supply roll, the metering member, and the impression surface form a part of a press for supplying ink to sheets or to a continuous web substrate.

17. The apparatus of claim 1 wherein the liquid-carrying cylinder or roll, the liquid supply roll, the metering member, and the impression surface form a part of a liquid coater for applying a high volume of coating to a substrate.

18. The apparatus of claim 13 in which the resilient surface produced with said screen is configured to carry a volume of liquid of at least about 19.8 billion cubic microns per square inch.

19. The apparatus of claim 7 wherein the reliefs or dots comprise a screen-like pattern.

20. The apparatus of claim 1 wherein the impression surface is positioned to impress the printed substrate between the impression surface and the resilient liquid transfer surface.

21. The apparatus of claim 1 wherein the impression surface is cylindrical and rotatable and is positioned to rotate together with the resilient liquid transfer surface.

22. The apparatus of claim 1 wherein the resilient transfer surface is smooth, and the indentations formed on the smooth resilient transfer surface are small cells, wherein the cells are substantially identical in volume carrying capability and distributed substantially uniformly over the smooth resilient transfer surface such that the volume of liquid per square inch is substantially equal over the entire resilient transfer surface.

23. The apparatus of claim 1 wherein the liquid supply roll is configured to carry a liquid load equal to or exceeding a liquid load that can be carried by the resilient liquid transfer surface.

24. The apparatus of claim 1 wherein the indentations are configured to carry a volume of liquid of at least about 19.8 billion cubic microns per square inch.

25. The apparatus of claim 1, further comprising:

a plate cylinder positioned to receive the liquid from the liquid-carrying cylinder or roll; and a blanket cylinder positioned to receive the liquid from the plate cylinder;

the impression surface being positioned to impress the substrate between the impression surface and the blanket cylinder.

26. The apparatus of claim 25, wherein the plate cylinder is configured to apply an inked image to the blanket cylinder, which is configured to print to the substrate.

27. The apparatus of claim 25, wherein the liquid-carrying cylinder or roll, the liquid supply roll, the metering member, the impression surface, the plate cylinder, and the blanket cylinder form a press for supplying ink to the substrate.

* * * * *